United States Patent [19]

Parrott et al.

[11] Patent Number: 4,548,509

[45] Date of Patent: Oct. 22, 1985

[54] MIXING DISC

[75] Inventors: Kenneth S. Parrott; Wendell K. Gillis, both of Spring; Bernard C. Baros, Conroe, all of Tex.

[73] Assignee: Clif Mock Company, Conroe, Tex.

[21] Appl. No.: 658,377

[22] Filed: Oct. 5, 1984

[51] Int. Cl.[3] ..... B01F 5/06

[52] U.S. Cl. ..... 366/349; 366/240; 366/340

[58] Field of Search ..... 366/340, 336, 337, 338, 366/339, 322, 333, 334, 335, 256, 257, 259, 260, 604, 348, 349, 240; 48/180.1; 100/245

[56] References Cited

U.S. PATENT DOCUMENTS

| | | | |
|---|---|---|---|
| 3,286,992 | 11/1966 | Armeniades | 366/336 |
| 3,861,652 | 1/1975 | Allen | 366/336 |
| 4,501,501 | 2/1985 | Edwards | 366/340 |

*Primary Examiner*—Robert W. Jenkins

*Attorney, Agent, or Firm*—Robert W. B. Dickerson

[57] ABSTRACT

A mixing disc for use in a fluid sampler, for purposes of homogeneously mixing the sampled fluid; the disc having a housing which positions therein a pair of spaced mesh screens, the mesh in the spaced screens being positioned 45° out of phase with each other.

10 Claims, 3 Drawing Figures

MIXING DISC

BACKGROUND OF THE INVENTION

Samplers have long been used to determine the precise make-up of fluids being used in many industrial activities, particularly with respect to hydrocarbon materials produced as a result of drilling activities. The entire testing process includes the taking, storing and analyzing of product samples. In order to achieve the degree of accuracy required, the analyzed product must be thoroughly mixed prior to analysis. Various mixing devices and techniques have been used. These prior art devices include (1) a mixing element attached to a shaft, which shaft and element extends within the sample cylinder and is moved therethrough; (2) one or more balls positioned interior of such cylinder whereby, on a shaking action being induced, turbulence is caused in the sampled fluid; and (3) a geometric blade being positioned within the cylinder and caused to gravity-fall therein. The following prior art examples were found by a search, namely U.S. Pat. Nos. 1,547,562; 2,535,387; 3,229,963; 3,390,580; 3,789,670; 3,793,886; 4,284,360; and 4,328,710.

Various deficiencies have occurred with respect to such products. These have included (1) hazardous conditions resulting when a shaft extends within a high pressure vessel; (2) turbulence causing mixing only in the area immediately surrounding a ball; and (3) shear, with resulting mixing, only along the entire line coursed by the gravity-descending blade or blades.

This invention has as its purpose the achieving of a thorough mixing throughout the sampled fluid provided the fluid cylinder.

SUMMARY OF THE INVENTION

The mixing disc of this invention comprises an annular ring or toroid. Balls, spaced apart by approximately 120°, are positioned within recesses in the ring periphery. Within the ring's central passageway, a pair of mesh members are fixedly, but removably positioned. The mesh or grid of the mesh members are rotated, relative to the opposite members, so as to be out of phase by approximately 45°.

DESCRIPTION OF A PREFERRED EMBODIMENT

Figure 1:
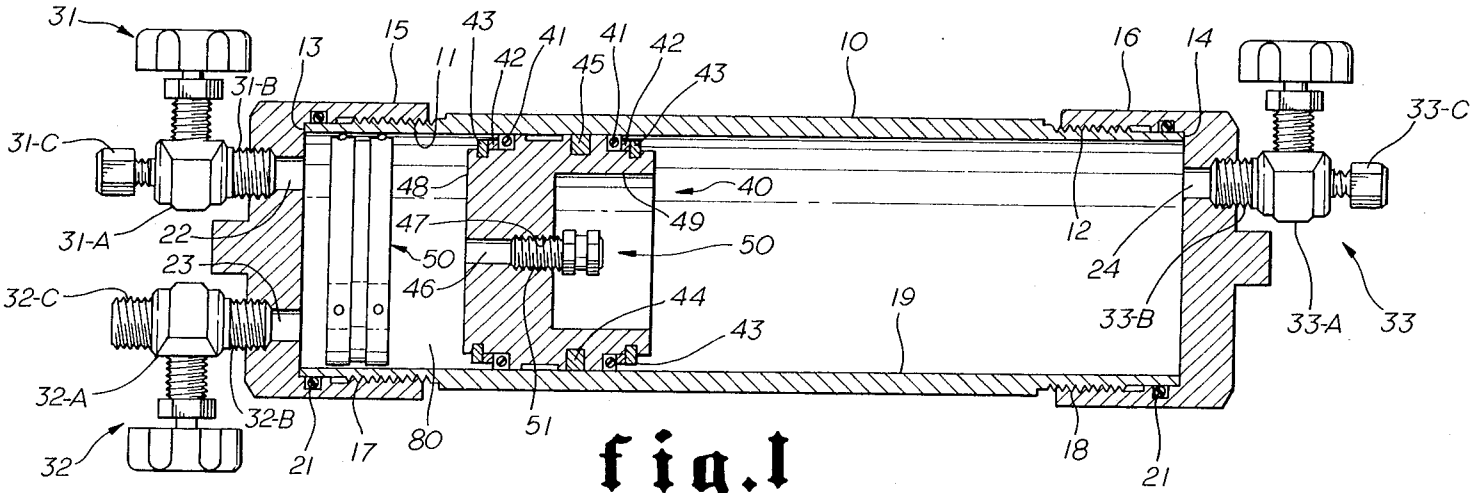
FIG. 1 is a vertical section through the fluid receptacle and movable piston, with the mixing disc, as well as the inlet and outlet fittings being shown in plan.

First consider the receptacle of FIG. 1. Such Figure depicts a cylinder 10, having an internal bore 19, externally threaded at 11 and 12, near its opposite ends 13, 14. Cup-shaped end caps 15 and 16 are interiorly threaded, as at 17, 18, to matingly engage said opposed cylinder threads. Annular O-rings 21 are strategically placed within cut-outs to prevent leakage between the cylinder and cups.

Threaded ports 22, 23 permit fluid passage through end cap 15 as does threaded port 24 through endcap 16. Similar fittings 31, 32, 33 are positioned within ports 22, 23 and 24. Each such fitting includes a needle valve, 31-A, 32-A, 33-A, a threaded, bored nipple 31-B, 32-B, 33-B and a threaded fluid passageway or tube fitting 31-C, 32-C, 33-C, in communicating relationship with nipples 31-B, 32-B, and 33-B through needle valves 31-A, 32-A and 33-A, respectively.

Slidable within the internal cylinder bore 19, is a cylindrical piston 40. For sealing purposes, spaced low friction ball seals 41, back-up rings 42 and retaining rings 43 are provided annular recesses around the periphery of the piston. A centrally disposed annular recess 44 receives a ring of carbon steel 45. An axial bore 46, internally threaded at one end 47, extends through web portion 48 of piston 40 to communicate with enlarged counter-bore 49. Relief valve assembly 50 has its externally-threaded nipple portion 51 communicatingly engaged with the threads of axial bore 46.

To this point, the sampler does not substantially differ, in operation, from prior art devices. The sampled product may be pumped from a sampled source (not shown), to inlet port 22. Equalizer port 24 may also be in communicating connection with such sampled line. At this point, needle valve 32-A would be closed so as to bar the sampled fluid from escaping through port 23. With the sampled fluid being pumped in, piston 40 would be urged to the right of the cylinder 10 of FIG. 1, with the fluid to be sampled occupying the fluid to be sampled occupying the space intermediate ports 22, 23 and piston web 48, defined by cavity 80. When piston 40 has been urged as near port 24 as desired, and expanded cavity 80 filled with the sampled fluid, then all three needle valves, 31-A, 32-A and 33-A would be closed. Cylinder 10 may be positioned vertically, with end cap 15 above end cap 16, permitting mixing disc 50 to gravity fall. Subsequently, the cylinder 10 may be inverted, again permitting such gravity fall.

Now consider the specific inventive aspects of this invention, i.e., the mixing disc.

Figure 3:
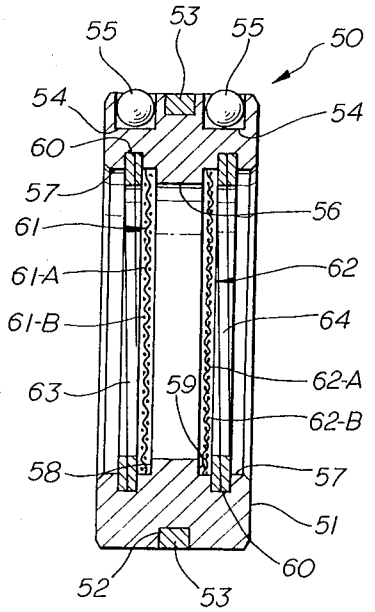
FIG. 3 is a sectional view taken along lines 3—3 of FIG. 2.
Figure 2:
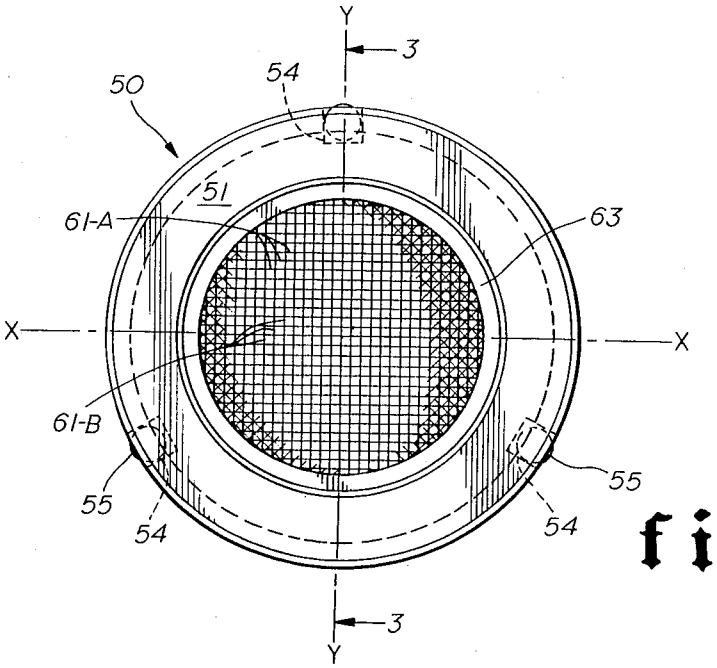
FIG. 2 is a front elevation of the mixing disc.

Movably positioned within cylinder bore 19, intermediate piston web 18 and end cap ports 22, 23, is the mixing disc 50 (see FIGS. 2 and 3). The disc includes a corrosion resistant ring-like housing 51, preferably of stainless steel. An annular recess 52 receives annular pick-up ring 53, said ring being comprised of magnetic or magnetizable material—thus permitting externally controlled or controllable disc movement. Three pairs of spaced (by approximately 120°), ball-accommodating, recesses 54 are illustrated around the periphery of ring 51. Within each such recess is a ball 55, fabricated of low-friction material. The outside diameter of disc 50, including the slight extension of balls 55 therebeyond, approximates the internal diameter of bore 19 of cylinder 10. This permits disc 50 to smoothly move along such I.D., without misalignment or scarring the cylinder wall. Further, through the screen members hereinafter described, substantially all the sampled fluid within cavity 80 is operated on by mixing disc 50.

Consider now the screen assembly. Ring 51 is seen in FIG. 3 to have a central, axial bore 56, axially aligned counter bores 57, such bores being linked by spaced shoulders 58 and 59. Said opposed counter-bores 57 each include an annular recess 60. An opposed pair of annular mesh or grid elements 61, 62 are spacedly positioned within counter bores 57, adjacent shoulders 58, 59 respectively. Such members 61, 62 are each secured by a spiral snap ring 63, 64, the peripheral edges of each being snapped into one of opposed recesses 60. Mesh members 61, 62 each include a plurality of interlaced wires.

Member 61 (see FIG. 2) includes wire members 61-A arranged parallel to axis X—X and similar members 61-B arranged perpendicular thereto, i.e., parallel to axis Y—Y. Mesh member 62 would have its members 62-A and 62-B rotated by 45°, relative to members 61-A and 61-B. In effect, shear is effected substantially throughout the entire volume of sampled fluid, resulting in a more homogeneous mixture than has heretofore been possible.

After the mixing disc process described above, the thoroughly mixed, sampled fluid may be drawn off in a conventional manner through port 23, after opening needle valve 32-A, to be analyzed.

Although only a single embodiment has been described, it should be obvious that numerous modifications would be possible by one skilled in the art without departing from the spirit of the invention, the scope of which is limited only by the following claims.

We claim:

1. In a fluid sampling device having an invertible, sample-receiving cylinder, the improvement comprising a fluid mixing member, said mixing member including:

a centrally bored housing, movable within said cylinder;

a pair of spaced apart mesh members centrally positioned within said housing bore, each said mesh member including a first plurality of shear-causing elements arranged substantially perpendicular to a second plurality of shear-causing elements; and the shear-causing elements of one of said mesh members are arcuately out of phase with the shear-causing elements of the other of said mesh members.

2. The device of claim 1 wherein the external periphery of said mixing member housing is correlative in configuration with the internal configuration of said sampling device cylinder.

3. The device of claim 1 wherein said mixing member housing is annular in its peripheral configuration.

4. The device of claim 1 wherein said mesh members' shear causing elements are approximately 45° out of phase.

5. In a fluid sampling device having a sample-receiving cylinder, the improvement comprising a fluid mixing member, said mixing member including:

a centrally bored housing, said mixing member housing being annular in its peripheral configuration, said housing accommodating a plurality of low friction balls and the O.D. of said housing is only slightly less than the I.D. of said cylinder; and a pair of spaced apart mesh members centrally positioned within said housing bore, each said mesh member including a first plurality of shear-causing elements arranged substantially perpendicular to a second plurality of shear-causing elements, all of said shear-causing elements of one of said mesh members being approximately 45° out of phase with the shear-causing elements of the other of said mesh members.

6. A fluid mixing device, adapted to gravity move through a fluid, comprising:

an annular, centrally bored, housing;

a pair of mesh members centrally positioned within said housing bore, each said mesh member including a first plurality of shear-causing elements arranged substantially perpendicular to a second plurality of shear-causing elements, substantially all of said shear causing elements of one of said mesh members are arcuately out of phase with their counterpart shear-causing elements of the other of said mesh members.

7. The fluid mixing device of claim 6 wherein said shear-causing elements are approximately 45° out of phase.

8. The fluid mixing device of claim 7 wherein said housing accommodates a plurality of low friction balls around said housing's periphery.

9. A fluid mixing device comprising:

an annular centrally bored housing;

a pair of spaced apart mesh members centrally positioned within said housing bore, each said mesh member including a first plurality of shear-causing elements arranged substantially perpendicular to a second plurality of shear causing elements; and a plurality of low friction balls around said housing's periphery.

10. The fluid mixing device of claim 9 wherein each of said balls is separated from the nearest adjacent ball by approximately 120°.

* * * * *